US005592977A

United States Patent [19]

Kikuchi et al.

[11] Patent Number: 5,592,977

[45] Date of Patent: Jan. 14, 1997

[54] MULTI-LAYERED WOVEN BELT WITH ROPE SHAPED PORTION

[75] Inventors: Koichi Kikuchi, Shimada; Masao Watanabe, Shizuoka, both of Japan

[73] Assignee: Kikuchi Web Tech Co., Ltd., Tokyo, Japan

[21] Appl. No.: 284,640

[22] PCT Filed: Dec. 15, 1992

[86] PCT No.: PCT/JP92/01632

§ 371 Date: Aug. 15, 1994

§ 102(e) Date: Aug. 15, 1994

[87] PCT Pub. No.: WO94/13872

PCT Pub. Date: Jun. 23, 1994

[51] Int. Cl.[6] ..... D03D 1/00; D03D 11/00; D03D 35/00

[52] U.S. Cl. ..... 139/387 R; 139/408; 139/305; 139/22; 428/257; 428/36.1; 294/74

[58] Field of Search ..... 139/408, 387, 139/305, 22, 23, 384 R, 383 R; 428/257, 36.1; 294/74; 87/8, 9

[56] References Cited

U.S. PATENT DOCUMENTS

| | | | |
|---|---|---|---|
| 4,209,044 | 6/1980 | Taki . | |
| 4,354,704 | 10/1982 | Mayerjak | 294/74 |
| 4,640,317 | 2/1987 | Chardon et al. | 139/431 |
| 5,219,636 | 6/1993 | Golz | 294/74 |

FOREIGN PATENT DOCUMENTS

| | | | |
|---|---|---|---|
| 0145615 | 10/1984 | European Pat. Off. . | |
| 516027 | 12/1992 | European Pat. Off. | 139/387 R |
| 2113022 | 10/1971 | Germany | 294/74 |
| 2364982 | 7/1974 | Germany . | |
| 333275 | 8/1930 | United Kingdom . | |

OTHER PUBLICATIONS

Microfilm of the specification and drawings annexed to the written application of Japanese Utility Model Application No. 60737/1982 (Laid–Open No. 163959/1983), (Kopal K.K.), Nov. 1, 1983 (01.11.83), FIG. 1 (Family:none) No English Translation.

JP, A, 53–130134 (Yanmar Agricultrual Equipment Co., Ltd.), Nov. 13, 1978 (13.11.78), FIG. 1 (Family:none) No English Translation.

Microfilm of the specification and drawings annexed to the written application of Japanese Utility Model Application No. 128560/1981 (Laid–Open No. 34871/1983), (Kanebo Gosei Kagaku K.K. and another), Mar. 7, 1983 (07.03.83), (Family:none) No English Translation.

Microfilm of the specification and drawings annexed to the written application of Japanese Utility Model Application No. 62490/1980 (Laid–Open No. 165081/1981), (Sanshin Seisen K.K.), Dec. 7, 1981 (07.12.81), (Family:none) No English Translation.

JP, V2, 63031576 No English Translation (Forell), Jun. 24, 1988 (24.06.88), & US, A, 4640317.

*Primary Examiner*—Andy Falik

*Attorney, Agent, or Firm*—Harris Beach & Wilcox, LLP

[57] ABSTRACT

A woven belt having thick and narrow portions with a breaking strength per unit width that exceeds the level of strength of conventional fabric straps and belts. One embodiment of the belt includes at least four layers of weave structure in which two outer layers are woven into a hollow tube by a common weft and the remaining inner layers are woven together by a second weft. The widthwise central area of the belt is provided with a thickness that is larger than a quarter of the belt width.

8 Claims, 8 Drawing Sheets

MULTI-LAYERED WOVEN BELT WITH ROPE SHAPED PORTION

TECHNICAL FIELD

The present invention relates to a thick belt and a device for producing the same, particularly to a thick high-strength belt used, in place of a rope, as a safety belt or for a sling for a flexible container.

BACKGROUND ART

A safety belt generally comprises a metal member attached to one end of a rope and a hook attached to the other end thereof. In a sling for a flexible container, a rope is connected to a metal member attached to a container body. Usually the connection of the rope with the metal member is carried out manually by a process in which a rope end is untwisted to a group of strands which are then fixedly incorporated into the rope body. Since this process requires skill as well as considerable strength, it is difficult to obtain operators therefor nowadays. If a narrow width woven fabric is used in place of a rope, the connection may be easily carried out through a sewing operation, but the handling thereof is inferior to that of a rope due to its width.

In a woven fabric used for a sling requiring a high strength, it is necessary to weave a number of warps into a predetermined width of the fabric, whereby the fabric must be three layerd, or two layered while adding a plurality of reinforcing core yarns. An inspection of eight slings available in the market showed that the average thickness was 4.17 mm and the maximum thickness was 5.2 mm (nylon). An estimate was obtained, from the investigation of these weave structures, that the average breakage strength is 7,820 Kgf and the maximum is 10,680 Kgf (polyester) if a strength utilization ratio is assumed to be 80%. As there is a limit to the number of warps that can be woven into a predetermined width, it is necessary to weave fabrics to be undesirably wide in order that the strength requirement is fulfilled. Of course, specially high-strength yarns, such as aramide fiber yarns, may be used for this requirement, but these are so expensive that they cannot be used for general purposes.

The limitation of the number of warps that can be woven into a predetermined width of a narrow width fabric, is mainly determined by the capacity of the loom on which the fabric is produced. It is the above-mentioned slings that are designed and produced within such a strict limitation of the number of warps and thus these fabrics were produced under an extremely uppermost verge of the limitation of the conventional art. The limitations of loom will be described below.

In a needle-type narrow loom, a weft is picked into a warp shed from one side thereof, and received by a latch needle positioned on the other side so that a knitted selvage is formed. During the formation of the selvage, the weft is first caught by a hook of the latch needle. There is no problem when the weft is received by the hook from a back layer of a multilayered thick fabric, but when it is received from a front layer, the weft is liable to detach from the hook if the weft is positioned above a tip end of the hook. Accordingly, a fabric thickness under which a weaving operation is stably carried out is less than 5 mm in a gray fabric, and less than 4.5 mm after the heat-set has been carried out thereto.

In a rack-and-pinion type narrow loom, the weaving operation can be relatively smoothly continued even if a number of warps are woven, because a shuttle passes through a center of shedding while being gripped. However, there is one drawback therein. That is, it is necessary to increase the lengths of shuttle and shuttle box relative to the dimensions of the weaving window so that the shuttle is retained in the original shuttle box until a rack of the shuttle engages with a pinion of an opposite shuttle box. This results in the lowering of loom rotational speed, and since a wider space is required, the loom is generally designed as narrow as possible provided the shuttle can be safely passed. Therefore, if a shedding motion is even slightly disturbed when an extremely thick belt is woven, the passage of shuttle is obstructed and this causes a machine failure.

In a slide-hook motion-type narrow loom, a slide bar movable both in the right direction and left direction with reference to FIG. 10A, is provided in part of a shuttle race. A vertical groove is provided in the slide bar, in which a hook is movable upward and downward by a cam provided inside a slay. Two holes are bored, respectively in the right and left areas of the bottom wall of the shuttle for receiving the hook therein when the shuttle is in the shuttle box to move the shuttle along by the displacement of the slide bar, while the hook is lowered when the shuttle passes through the weaving window. After the shuttle has passed through the weaving window, the hook returns to the hole in the bottom wall of the shuttle to assist the movement of the shuttle.

In the slide-hook motion-type narrow loom, lower side warps forming a shed are brought into contact with the race and the shuttle runs thereon. When an extremely thick belt is woven in which a warp volume exceeds a certain level, the shuttle cannot clear the same, and becomes liable to float, resulting in unstable running and machine failure.

Further, while all parts in the loom frame, the motor arrangement, the weft picking mechanism, the shedding mechanism such as a dobby or the like, and the take-up device must be constructed to be resistant to the high warp tension, this requirement is not satisfactorily fulfilled by the conventional loom.

OBJECTS AND SUMMARY OF THE INVENTION

An object of the present invention is, in a wider sense, to provide a narrow width fabric having a thickness and a breakage strength per unit width exceeding conventional knowledge and, in addition, to provide a device for producing such a narrow fabric.

A first specific object is to produce a thick belt having a cross-sectional shape as close as possible to that of a rope.

A second specific object is to produce a narrow fabric having a thickness more than 6 mm and a high breakage strength, which has not been obtainable by a conventional art.

A third specific object is to obtain connection means for the belt of the first object as with a rope, by forming the fabric end wider, and with a suitable thickness, to allow a sewing operation thereon.

A fourth specific object is to provide a device in a loom which enables the execution of the first and second objects.

To achieve the above objects, a thick belt is provided, having a weave structure comprising at least four layers, in which the outer two layers are woven in a hollow weave while using a common weft and the inner layers other than the outer two layers are woven in a hollow weave while using another weft, characterized in that a thickness in a widthwise central area of the belt is more than one quarter of the belt width. Also a thick belt having a weave structure comprising at least two layers characterized in that the thickness of the warp bundle calculated by the formula (1) as shown in page 8, based on a total denier of all the warps used is more than 2.5 mm and the thickness of the woven belt is more than 6.0 mm except for the selvage area of the belt. More specifically, the belt has a basic section comprising the thick belt defined above and a flat section extending lengthwise from the basic section which is wider and thinner than the basic section; the flat section comprising a woven structure different from that of the basic section and being wider and thinner relative to the basic section.

Since the thick belt defined in the present invention comprises the above technical constituents, a high density, multilayered woven structure can be effectively obtained by utilizing a loom, while, in the conventional process, a plurality of yarns are knitted into a rope in an ineffective manner. This novel thick belt has a strength equal to that of the conventional rope and can be used in place thereof. According to the present invention, a required rope-like structure can be obtained through a usual sewing process instead of the process used for a conventional rope.

DETAILED DESCRIPTION OF THE DRAWINGS

A thick belt according to the present invention will be described below in more detail with reference to the drawings. In the description, "layer" stands for a unit of woven structure formed by the intersection of warp and weft. A structure, such as reinforcing core yarn group in which the warp and weft are not intersected with each other is not referred to as "layer".

Figure 1:
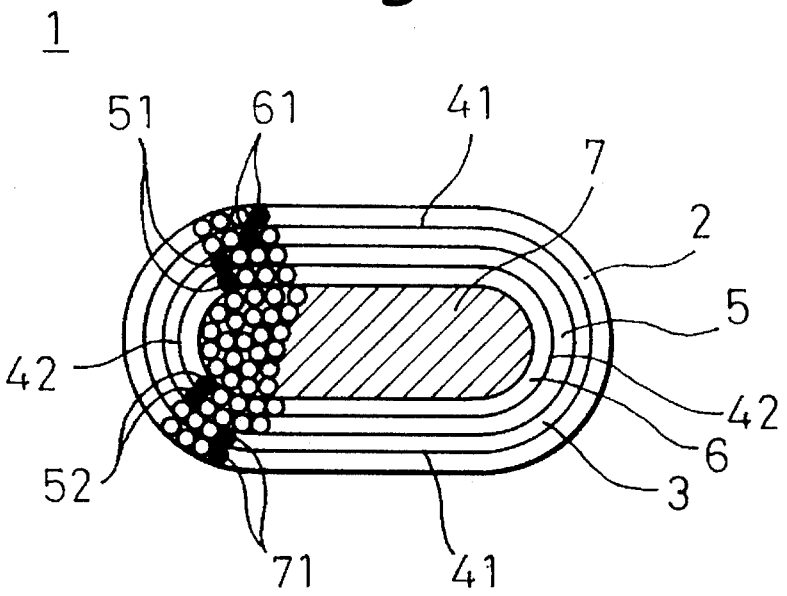
FIG. 1 is a cross-sectional view of a thick belt according to the present invention, illustrating one example of woven structure thereof.

FIG. 1 is a schematic illustration of cross-section of a thick belt woven using double shuttles for one belt. In the illustrated example, the thick belt 1 consists of four layers; outer layers 2, 3 and inner layers 5, 6. For simplicity, the respective layer is shown in a weave structure of 1/1, but other structures such as 2/1, 2/2, 3/1 or 3/3 may be preferably used because a number of warps can be woven into a predetermined width of the belt. In the outer layers 2, 3, warps 61, 71 thereof are woven in a hollow weave by a common weft 41. Also in the inner layers 5, 6, warps 51, 52 thereof are woven in a hollow weave by a common weft 42. It is possible to form the inner layers as more than three layers. In the latter case, although the inner layers are not tubular, there is no problem. In the usual multilayered weave, connecting yarn is used for connecting the respective layers with each other. However, the connecting yarn is not used in this case, and the warps 61, 71 are not restricted by the connecting yarn and liable to be in a tubular form if the weft is picked at a high tension. Thus, the belt has a substantially oval shape in cross-section as shown in FIG. 1. To obtain such a shape, it is indispensable to weave the outer layers 2, 3 in a tubular form while using the common weft 41, and to form the inner layer with at least two layers 5, 6 while using another weft 42 to thicken the central area of the belt. Although the warps 61, 71 of the outer layers are preferably of the same material and thickness, this is not an indispensable condition. Since the inner warps are invisible from outside, they are preferably arranged so that thicker yarns are closer to a widthwise central area of the belt, whereby the central area is further thickened. In this case, the connecting yarn may preferably be used only in the inner layers. The connecting yarn used is preferably one having a good elasticity. Reinforcing core yarns may be arranged between the adjacent layers, if necessary. A group of reinforcing core yarns 7 are arranged between the inner layers 5, 6 in the example shown in FIG. 1. More warps are preferably distributed in a central area of a front reed than in the remaining area. According to these weaving conditions, it is possible to obtain a thick belt with a cross-sectional shape closer to that of a rope. In addition, when a heat set is applied thereto, the cross-section of the belt becomes circular, whereby a product far from the concept of the conventional belt and having a cross-sectional shape similar to that of a rope can result. It is necessary that, after the heat set, the belt has a thickness of at least one quarter of the belt width in a widthwise central area thereof, which is the smallest thickness for easy manipulation. For example, when the belt width is 32 mm, the thickness in the central area should be more than 8 mm.

Figure 2:
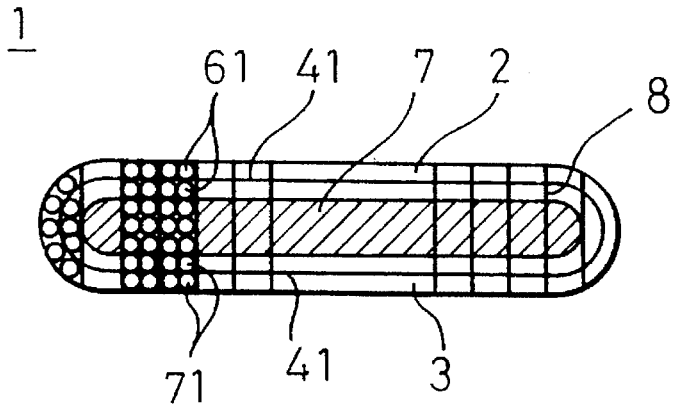
FIG. 2 is a cross-sectional view of another thick belt according to the present invention, illustrating another example of woven structure thereof.

FIG. 2 shows a schematic cross-section of one embodiment of a thick belt which is similar to a sling. In the illustrated embodiment, the thick belt 1 has a cross-sectional configuration such as a flattened rectangle shape and consists of two outer layers (front and back) 2, 3, a group of reinforcing core yarns 7 interposed between both the layers and a connecting yarn 8 connecting the front and back layers. Even though three or four layers are possible in this embodiment, these layers are woven by only one weft 41. The use of single weft is not an indispensable condition but two wefts may be used as shown in FIG. 1. FIG. 2 illustrates a very common structure of a thick belt, having characteristics in that the total denier of the warps used is larger than the conventional thick belt, resulting in a high breakage strength per unit width and a thickness, except for the selvage area 72, of more than 6 mm after heat setting operation was carried out. The characteristics will be described below in more detail.

The following factors determine the breakage strength and thickness of a narrow woven fabric:

1. Quality (breakage strength), denier and number (total denier) of warps used in the fabric;

2. Weave structure, weft denier and picks of weft per unit length.

When a woven fabric is designed, it is usual that material, denier and number of warps to be used are first decided while taking a required fabric strength into account, then a weave structure, weft denier and picks of weft per unit length are selected in a limited range defined in accordance with a weaving technology. Regarding slings belonging to a field in which the maximum strength is required in a narrow width fabric, an analysis was made on the marketed products available from various makers and listed on Table 1. According to this table, a thickness of warp bundle used in the following formula was 2.02 mm on average value and 2.42 mm maximum, obtained by dividing a cross-sectional area of all warps by a belt width; and a belt thickness was 4.17 mm on average value and 5.20 mm maximum. It was assumed that nylon and polyester yarns have a breakage strength of 9 g/d and the strength utilization ratio is 80%.

Calculation formulas:

$$0.0119\sqrt{(\text{total denier of warps} \div \text{fiber specific gravity})} = \text{diameter of warp bundle assuming the same has a circular cross-section (mm);} \quad (1)$$

$$\text{Cross-sectional area of warp bundle obtained by the above formula (mm}^2\text{)} \div \text{woven width of belt (mm)} = \text{thickness of warp bundle (mm).}$$

a gradually varying width. The basic section 10 is a belt formed of a woven structure consisting of at least four layers, in which the outer two layers are woven in a hollow weave by a common weft and the remaining layers other than the outer two layers are woven as inner layers by another weft. The thickness in the widthwise central area of the belt is larger than a quarter of the belt width.

Figure 3:
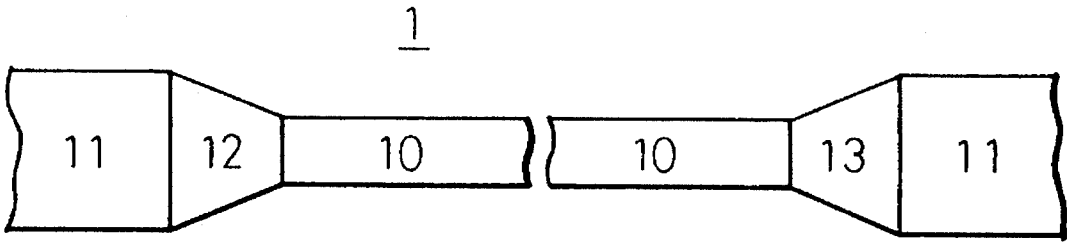
FIG. 3 is a plan view of a thick belt, illustrating an arrangement of the basic section and the wider sections.

The wider section 11 is formed wider and thinner relative to the basic section 10 to be suitable for the sewing operation. The width of the wider section is preferably wider by at least 50% than that of the basic section 10. Assuming that the belt is woven from the left to the right as seen in FIG. 3, the joint section 12 is formed so that the width thereof is gradually made narrower and the thickness thereof is gradually thicker, while the joint section 13 is formed so that the width thereof is gradually wider and the thickness thereof is gradually thinner. Lengths of the basic section 10 and the wider width section 11 are selected to be suitable for the expected use. The weaving process will be described below in detail.

Basically, the belt width is adjusted using a sector-shaped front reed which is movable upward and downward. In this regard, since the basic section 10 is thicker in the widthwise central area thereof, it is necessary to widen the thick portion as much as possible in the wider section 11. For this purpose, the reed pitch is not uniform in the wider section, but coarser in the central area and gradually finer toward the outside.

In the conventional belt with varying width, the same weave structure is used in both the narrower and wider

TABLE 1

| Maker | Weave | Loom | Material | Thickness (mm) | Width (mm) | Total denier | Assumed strength (Kgf) | Per 10 mm width Denier | Diameter | Thickness | Strength |
|---|---|---|---|---|---|---|---|---|---|---|---|
| A | 1/1 2 layers | shuttle | nylon | 3.50 | 51.9 | 946620 | 6816 | 182393 | 4.76 | 1.78 | 1313 |
| B | 1/1 2 layers | shuttle | nylon | 3.95 | 49.6 | 1022280 | 7360 | 206105 | 5.06 | 2.01 | 1484 |
| C | 1/1 3 layers | shuttle | nylon | 4.00 | 52.6 | 1038240 | 7475 | 197384 | 4.95 | 1.92 | 1421 |
| D | 1/1 3 layers | shuttle | nylon | 5.20 | 51.2 | 1155840 | 8322 | 225750 | 5.30 | 2.20 | 1625 |
| E | 1/1 3 layers | shuttle | nylon | 4.10 | 52.2 | 1000440 | 7203 | 191655 | 4.88 | 1.87 | 1380 |
| F | 2/2 2 layers | shuttle | nylon | 4.20 | 49.7 | 1051680 | 7572 | 211606 | 5.13 | 2.06 | 1524 |
| G | 2/1 2 layers | needle | nylon | 3.50 | 51.1 | 990360 | 7131 | 193808 | 4.91 | 1.89 | 1395 |
| H | 1/1 2 layers | needle | polyester | 4.88 | 49.4 | 1483000 | 10678 | 300202 | 5.55 | 2.42 | 2161 |
| Average | | | | 4.17 | 51.0 | 1086058 | 7820 | 213613 | 5.07 | 2.02 | 1538 |
| Ref. | | | nylon | 6.00 | 50.0 | 1280000 | 9216 | 256000 | 5.64 | 2.50 | 1843 |
| Ref. | | | polyester | 6.00 | 50.0 | 1550000 | 11160 | 310000 | 5.64 | 2.50 | 2232 |

*Calculations were made while assuming the specific gravity of nylon is 1.14 and that of polyester is 1.38.
*Assumed strength was calculated by [(total denier × 9 (g/d) × 0.8] ÷ 1000.

From the analysis of the conventional narrow fabrics shown in Table 1, which are thought to be high-quality, it is decided in the present invention that the thickness of warp bundle should be at least 2.5 mm and the belt thickness should be at least 6.0 mm so as to exceed the quality of the conventional products. Values cited as reference in Table 1 are obtained by the reverse calculation while defining the thickness of warp bundle as 2.5 mm.

FIG. 3 illustrates a belt comprising a basic section 10 halving a rope-like shape shown in FIG. 1, wider width sections 11 extending from the lengthwise opposite ends of the basic section 10 and joint sections 12, 13 connecting both of the former two sections with each other and having sections. However, according to the present invention, since the basic section 10 comprises at least four layers in its weave structure and is difficult to widen while maintaining this weave structure, the number of layers in the basic section 10 is reduced in the joint section 13 so that the width can be readily increased. That is, if the basic section 10 has four layers, the number of layers is reduced to two in the joint section 13 and in the wider section. If the width variation is greater, the number of layers in the joint section may be further reduced from two to one for the wider section. Beside the reduction of the number of layers, it is possible to convert the weave structure of the respective layer, for example, from 2/2 twill weave to 1/1 plain weave. However, it is better to vary the number of yarns in a warp unit, while maintaining the weave structure as it is, so that the number of layers can be reduced without affecting the product appearance. When the joint section 12 changes from the wider section 11 to the basic section 10, the weaving process is carried out in a reverse manner to the above.

The basic section 10 having the wider section 11 is designed so that a reduction or increase of layers is facilitated. For example, it is preferable not to use reinforcing core yarns in the basic section 10 because the conversion of weave structure becomes difficult. In this regard, it may be possible to build a proper number of reinforcing core-like yarns into the basic section 10 and use the same as connecting yarns when the number of layers is reduced to two or three in the wider section 11, so that the wider section is stable.

While it is necessary to vary a weft picking number per unit length in accordance with the reduction or increase of layers and the change of width, the detailed description thereof is eliminated in this specification because such a procedure is well-known from the prior art.

Next, looms and other devices for producing the thick belt described with reference to FIGS. 1 and 2, and having a thickness larger than that of the conventional belt, will be explained.

As stated in the prior art, the maximum number of warps capable of being woven into a predetermined width of narrow fabric is mainly decided by the limitations of a loom, and it was found that the thick belt of the present invention cannot be produced while using a conventional loom. Accordingly, the present inventors have studied how to develop a loom, and devices thereof, capable of producing a thick belt according to the present invention.

Two shuttles are necessary for the production of the belt shown in FIG. 1. In the rack-and-pinion type loom, a double shuttle mechanism becomes complicated because one shuttle is exchanged with the other while moving upward and downward, which results in the reduction of the loom rotational speed. The slide hook motion type loom is thus preferably used, because two shuttles are positioned in a side-by-side manner in the same shed and either can be selected by a relatively simple means. In the conventional loom of this type, however, as explained with reference to FIG. 1, when a thick belt is woven thereon, having a thickness in the widthwise central area larger than one quarter of its width after heat setting, the thickness of the warp bundle becomes more than 5 mm in the widthwise central area during the weaving process, if the warps are drawn into, for example, a 35 mm wide a front reed. The shuttle cannot run over lower side warps forming the shed when the warp bundle is extremely voluminous.

To solve this problem, according to the present invention, a stepped groove is provided in the shuttle race so that the lower warp bundle is positioned below the upper surface of the shuttle race when the shed is formed. In addition, a plurality of exchangeable parts are prepared, with varying groove depths and/or widths, so that a suitable stepped groove is provided corresponding to various belts of different widths and thicknesses.

Figure 4:
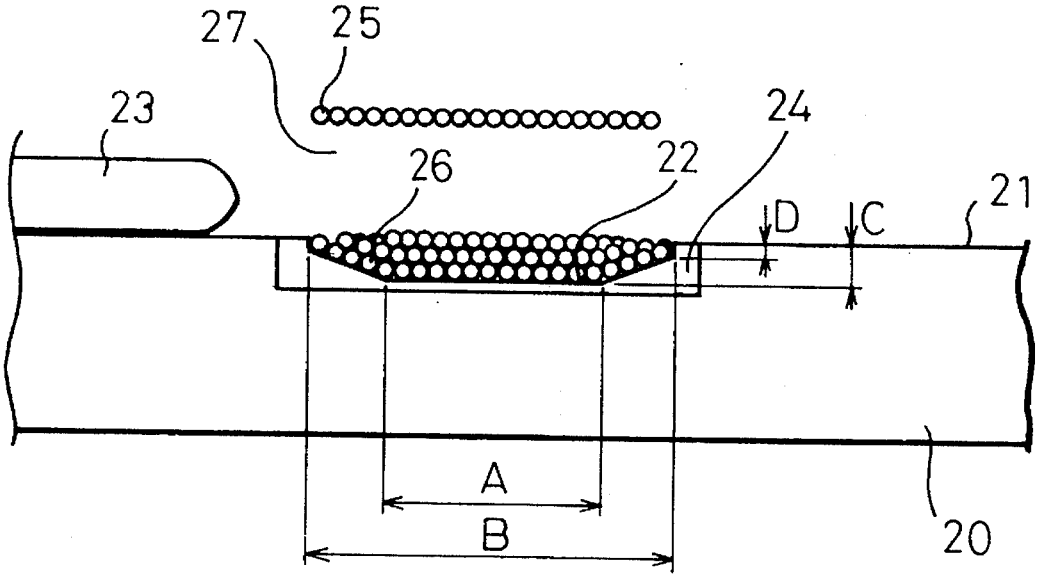
FIG. 4 is a cross-sectional view of a shuttle race used in the present invention, illustrating a shape of a stepped recess formed therein.

The detailed description will be made of the exchangeable part for the stepped groove with reference to FIG. 4. FIG. 4 illustrates one embodiment, in which an exchanging part 24 having a stepped groove 22 is fixed in a weaving window of a shuttle race 21 provided on the upper surface of a slay 20. The cross-sectional shape of the stepped groove 22 is preferably selected while taking into account the maximum volume of the lower warp bundle 26 forming a shed. It is variable in accordance with the weave structure, with reference to the cross-sectional shape of the thick belt to be woven, yarn material, denier or number of the warps. In Table 2, examples of the cross-sectional shape of the stepped groove 22 are shown. A total length B, bottom length A, maximum depth C and end depth D of the stepped groove are listed in Table 2.

TABLE 2

| | A | B | C | D |
|---|---|---|---|---|
| 1. | 35 mm | 65 mm | 5 mm | 2 mm |
| 2. | 20 mm | 40 mm | 8 mm | 4 mm |
| 3. | 50 mm | 50 mm | 5 mm | 5 mm |

In this regard, the use of the exchangeable part 24 is not indispensable, but the stepped groove having, for example, dimensions listed in item 3 of Table 2 may be directly formed on the shuttle race. That is, the groove having the maximum dimensions for the expected use may be originally provided.

According to such the arrangement, it is possible for the shuttle 23 to smoothly run through the shed 27 between the upper side warp bundle 25 and the lower side warp bundle 26 even though the lower side warp bundle is at the maximum volume when the warp bundle woven to be the thick belt forms the shed, because the lower side warp bundle can be accommodated in the groove 22.

Figure 10A:
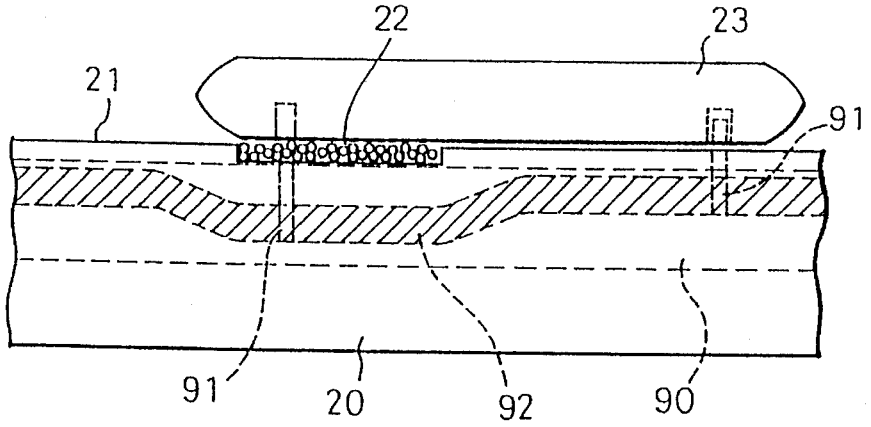
FIGS. 10(A) through 10(C) illustrate a slide hook mechanism of a shuttle loom used in the present invention.
Figure 10B:
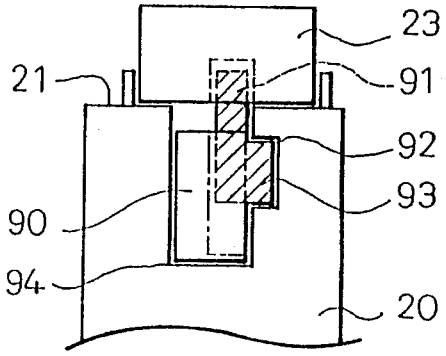
Figure 10C:
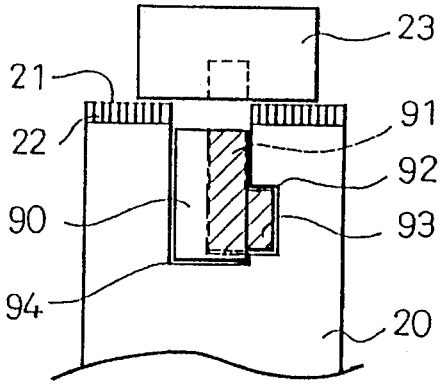

An embodiment of a slide hook motion mechanism used for the present invention will be explained with reference to FIGS. 10(A) through 10(C). In FIGS. 10(B), 10(C), a channel 94 opening to the shuttle race 21 is provided in the slay 20, for guiding a slide bar 90, and a cam 92 is provided in the inner side wall of the channel 94 in the lengthwise direction thereof (in the right or left directions in FIG. 10(A)). The cam 92 is closer to the shuttle race 21 beneath a non-illustrated shuttle box so that a tip end of a hook 91 enters a bore formed in the shuttle bottom, while the cam 92 is farther from the shuttle race 21 beneath the stepped groove 22 so that the tip end of the hook 91 can pass under the stepped groove 22. In short, in the present invention, the upper surface of the slide bar 90 is at a level lower than the bottom of the stepped groove 22 having the maximum depth, while in the conventional slide hook motion mechanism, it is at substantially the same level as the shuttle race 21.

FIG. 10(B) is the illustration of a positional relationship between shuttle race 21, slide bar 90, hook 91, cam 92 and shuttle 23 beneath the shuttle box, and FIG. 10(C) is that beneath the stepped groove 22. According to a protrusion 93 of the hook entering the cam 92, the hook is movable up and down according to the height variation of the cam 92. In this regard, the slide bar 90 is reciprocated right and left by a non-illustrated drive means. Through such the structure, the tip end of the hook 91 is projected upward and engages with the bottom bore of the shuttle 23 to displace the same in the right/left directions, or the tip end of the hook 91 disengages therefrom when the shuttle 23 passes the weaving window so that the displacement of the shuttle is stably carried out.

In the present invention, a slant section of the cam 92 is elongated compared with the conventional one to mitigate a shock caused by a longer up-down stroke of hook 91 due to the lower arrangement of the slide bar 90 and length of the shuttle 23 is also elongated. However, since such a modification can be designed when the length of the weaving window and the maximum depth of the stepped groove 22 are determined, a specific description is not given.

Next, a mechanism for taking up a thick belt according to the present invention during the weaving process will be explained.

Figure 5A:
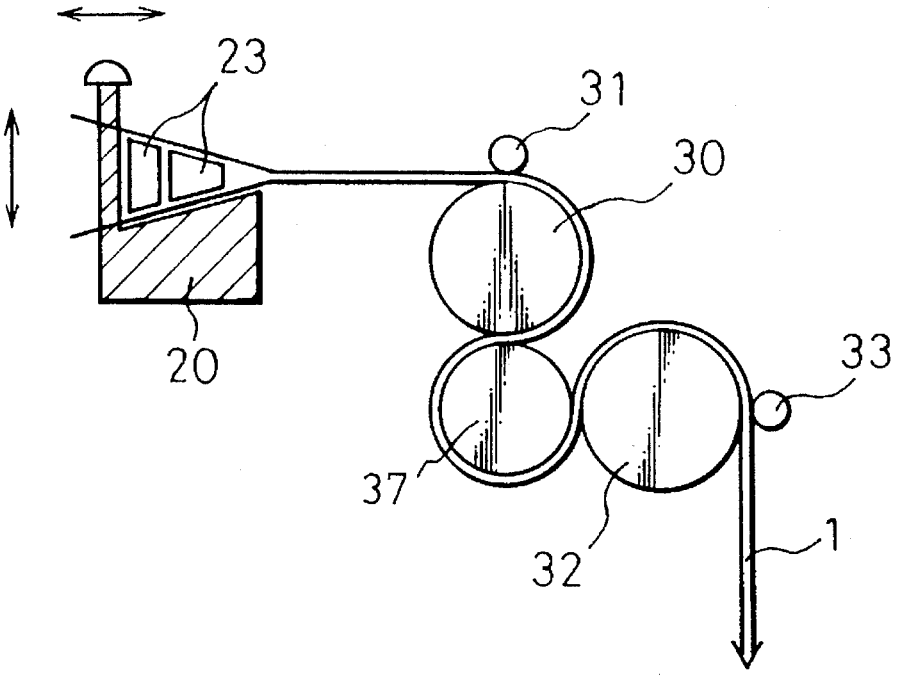
FIGS. 5(A) through 5(C) are side views of a take-up motion mechanism used in the present invention.
Figure 5B:
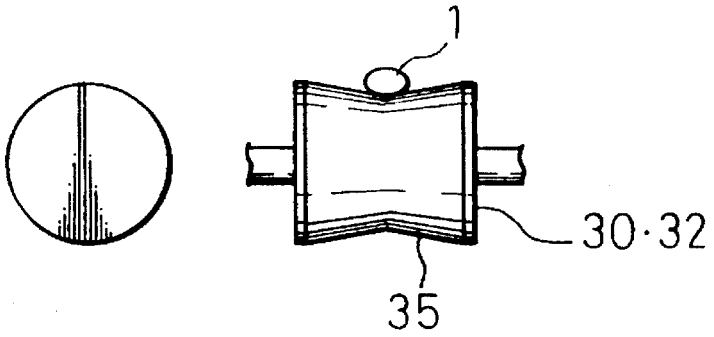
Figure 5C:
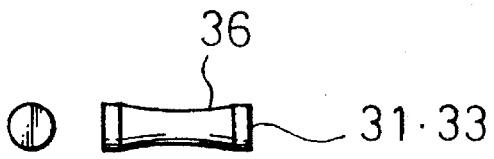

A take-up motion mechanism is provided in a narrow width loom, comprising at least two sets of roller unit, each consisting of a take-up roller and a press roller contacting the same, in which at least one roller in the respective roller unit has a circumferential groove 35 or 36 on the outer periphery thereof, as illustrated in FIGS. 5(B) and 5(C).

FIGS. 5(A) to 5(C) illustrate one embodiment of the take-up mechanism of the present invention. As shown in FIG. 5(A), a woven belt 1 is taken up by a first take-up roller 30 and press roller 31 set, and transferred to a second take-up roller 32 and press roller 33 set via an intermediate roller 37. The shape of groove 35, 36 provided on the outer periphery of at least one of take-up roller and press roller in the respective roller unit is designed to be conformable with the cross-sectional shape of the thick belt to be woven, as shown in FIGS. 5(B) and 5(C). Examples of the groove shape are illustrated in FIG. 6.

Figure 6A:
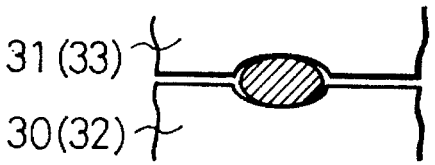
FIGS. 6(A) through 6(F) illustrate a shape of combination of take-up roller and pressing roller in a take-up motion mechanism, respectively.
Figure 6B:
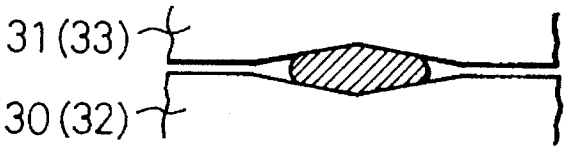

In FIGS. 6A and 6B, grooves of various shapes are provided on both of the take-up rollers and press rollers.

Figure 6C:
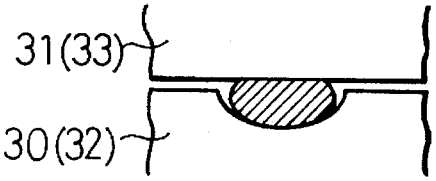
Figure 6D:
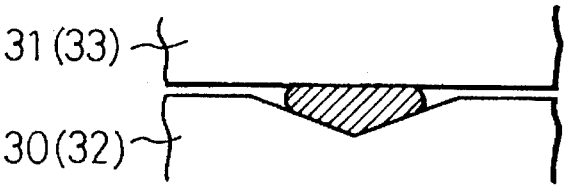

In FIGS. 6C and 6D, grooves of various shapes are provided only on the take-up rollers.

Figure 6E:
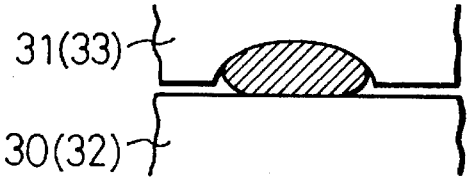
Figure 6F:
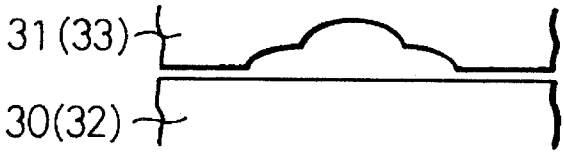

In FIGS. 6E and 6F, grooves of various shapes are provided only on the press rollers.

When the wider section is woven while varying the cross-sectional shape thereof, two press rollers with different grooves are preferably used while being combined with one take-up roller.

In practice, a plurality of these take-up rollers or press rollers, each having a groove different from the other, are preliminarily prepared as exchangeable parts so that replacement is easy.

The take-up roller shown in FIG. 5(B) has a relatively large diameter of 150 mm for taking up a thick belt.

While the structures of the loom, such as a loom frame, motor arrangement, picking motion, shedding motion or take-up motion mechanism are designed to be durable against high power for weaving a thick belt according to the present invention, compared with the conventional loom, they are not special but can be designed or selected on demand, whereby a detailed explanation is not given.

EXAMPLE 1

Yarn material: nylon

Weave structure: 2/2 twill weave, four layers

Fabric dimensions: maximum thickness 10 mm, width 26 mm

Front layer and back layer: warp 1680 d/4, 68 ends (warping on two beams)

Inner layers: warp 1680 d/4, 60 ends (warping on two beams)

weft 1680 d/l, 60 picks/3 cm no connecting yarns or reinforcing core yarns are used.

Figure 7:
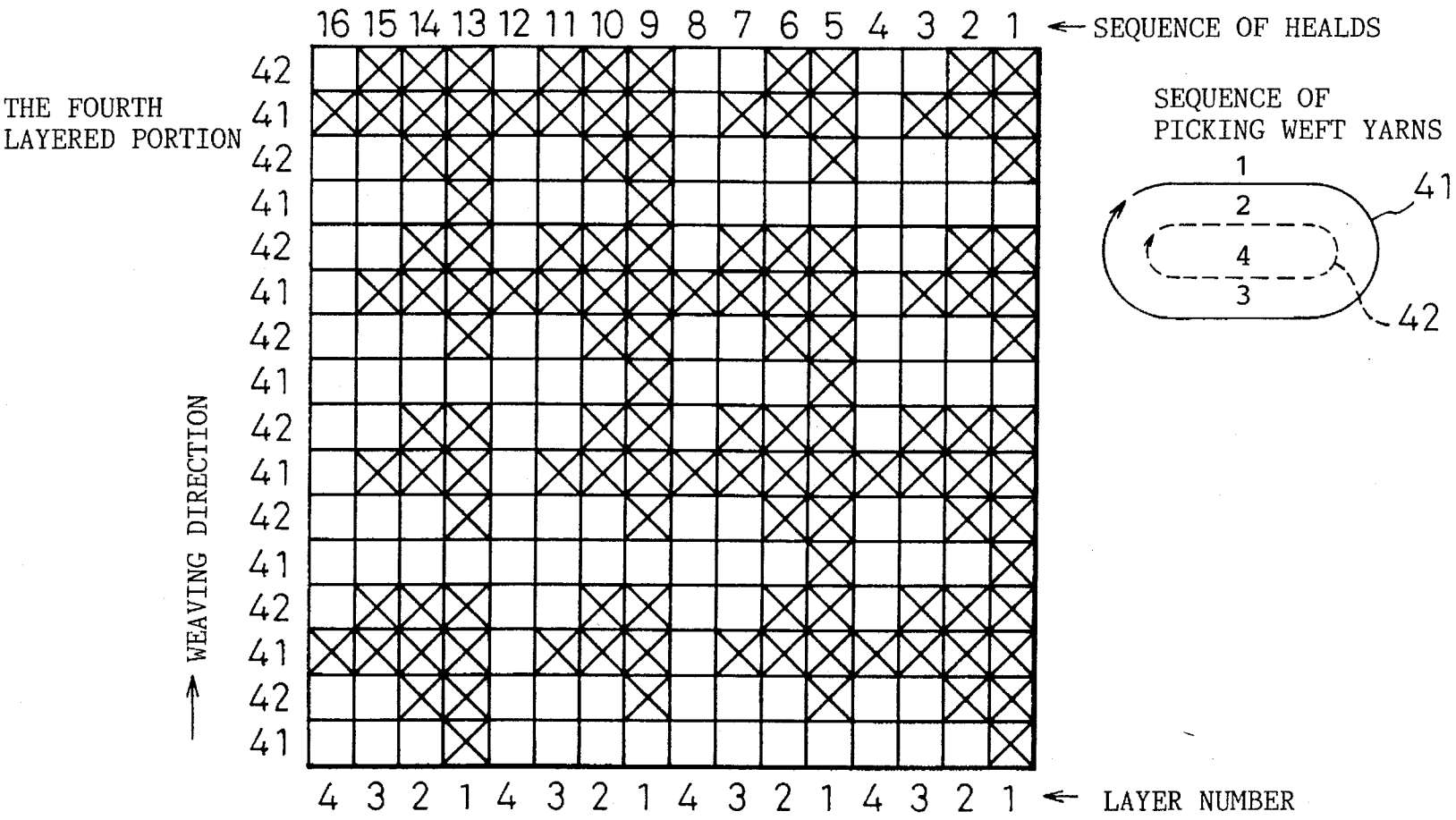
FIG. 7 is a weave structure used in a first embodiment of the present invention.

A thick belt was woven under the weaving conditions described above while using a narrow width loom of slide hook motion type designed for the production of a thick belt, with double shuttles, in the following manner.

a. Groups of warps of the 2/2 twill weave forming the respective layers were separately warped on the respective beams and drawn into four held. According to this arrangement, one half of the warps in the respective warp group were positioned on the upper or lower side of the shed when this warp group was woven, and the remaining warps were all positioned on the upper or lower side of the shed, whereby the shedding motion could be smoothly carried out even if the warp tension was small.

b. FIG. 7 illustrates a weave structure of the above belt. Since the inter-warp rubbing during the shedding motion is minimized, the shed is easily formed even though the warp density is high.

c. The weaving operation was carried out with the exchangeable part having a groove with a depth of 6 mm and a width of 35 mm in the weaving window in the sly. Although most of the ends (111 out of 128) are collected on the lower side of the shed consisting of 128 ends of warps of 1680 d/4, they are accommodated within the margin of the stepped groove, whereby no problems occur in the shuttle travel.

d. The shuttles were arranged in the same shed such that one is on the near side and the other is on the far side as seen from the front of loom. The nearer side shuttle (1) was used for weaving the inner two layers and the farther side shuttle (2) was used for the outer two layers. The order of picking is the one-after-another order; i.e., after (1) is picked, (2) follows in the same direction, then (1) is picked in the opposite direction, and next (2) follows thereto. Thereby the outer two layers and inner two layers were respectively woven to a tubular shape by one shuttle.

e. In this example, no connecting yarns were used so that the resultant product is as close as possible to a rope-like shape. Since a connecting yarn was not used at all and as the weave structure was a hollow weave, the shape of the woven product was deformable whereby the cross-section thereof easily becomes oval.

f. A take-up motion mechanism, similar to that shown in FIG. 5(A), in which the take-up roller and press roller had a groove shown in FIG. 6(A) was used.

g. Since the warps are thick relative to the fabric width and the number thereof is relatively few, the respective layer is woven in a non-compact manner. Accordingly, the weft can shrink after heat setting so that a tough and compact fabric is obtained. In addition, the oval cross-section was more obvious in the heat-set product than in the as-woven product.

h. The heat-set product had a width of 23.5 mm, a thickness of 9.6 mm in the widthwise central area and a breakage strength of 6100 Kgf, satisfying a JIS strength standard of 5940 Kgf for 18 mm diameter nylon rope.

While the above weave structure was selected in this example so that the width can be partially widened as stated later in Example 3, other structure may be adopted such that the outer layer may be a 1/1 plain weave, the number of the inner layers may be more than three, reinforcing core yarns may be inserted between the respective layers, or any other structure is possible to be used with reference to the number of healds used.

EXAMPLE 2

Yarn material: nylon

Weave structure: 1/1 plain weave, three layers

Fabric dimensions: thickness 7.2 mm, width 31.5 mm

Ground warp: 1680 d/4, 102 ends (warping together with selvage yarns on one beam per one of the three layers)

Selvage warp: 1680 d/2, 16 ends

Connecting warp: 1680 d/1, 18 ends (warping on one beam)

Reinforcing core warp: 1680 d/6, 34 ends (warping on one beam)

Weft: 1680 d/1, 30 pick/3 cm

Figure 8A:
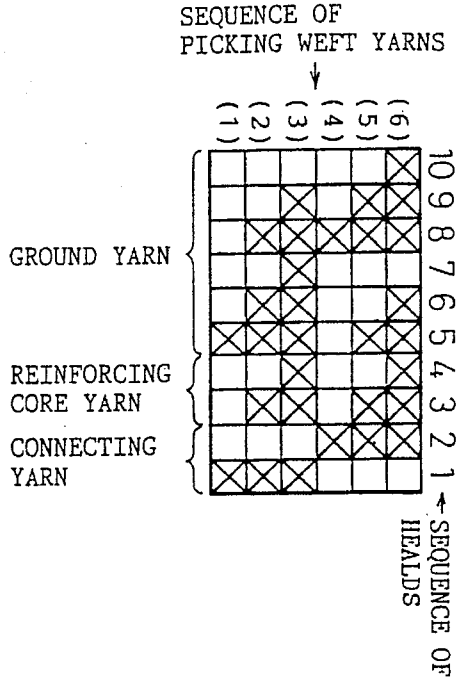
FIGS. 8(A) through 8(C) illustrate a weave structure used in a second embodiment of the present invention.
Figure 8B:
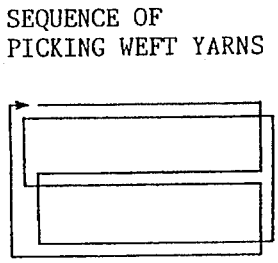
Figure 8C:
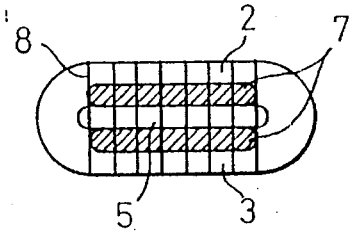

A thick belt was woven under the weaving conditions described above while using a narrow slide-hook motion type loom, designed for the production of thick belt, with double shuttles, in the following manner.

a. Thirty-four ground warps were warped for each of the three layers, while adding eight ends of selvage yarns respectively to the front and back layers. Each of the three layers was drawn into two healds. The connecting warps were also drawn into two healds and the reinforcing core warps were drawn into two healds (seventeen ends to one heald). The reason for the division of the beams is to reduce the warp tension during the shedding motion.

b. FIGS. 8(A) to 8(C) illustrate a weave structure of the above belt. Since the inter-warp rubbing during the shedding motion is minimized (only the connecting warps rub each other at a third pick), the shed is easily formed even though the warp density is high. The reinforcing core warps were inserted between the three layers while being divided into two groups.

c. In this example, it is not indispensable to use double shuttles, and a single shuttle may be used. Double shuttles may be used, taking weft supply conditions into account.

d. The thickness of the warp bundle determined by the formula described in the explanation of Table 1 was 3.44 mm because the total denier of warps is 1,112,160 denier and the fabric width is 31.5 mm. As described before, with reference to Table 1, the thickness of the warp bundle in the conventional product is at most 2.42 mm, and it is apparent that the warp volume is increased in this example.

e. The weaving operation was carried out while attaching an exchangeable part in the weaving window in the slay, having a stepped groove 4 mm deep and 40 mm wide. The maximum number of lower side warps forming a shed reached 577 ends, from a total of 662 ends, when a single end has a thickness of 1680 denier. Even in this case, the lower side warps were accommodated with a margin in the groove whereby there were no problems in the travel of the shuttle.

f. While a take-up motion mechanism similar to that shown in FIG. 5(A) was used, no circumferential groove may be necessary in the take-up roller or press roller in the case of the fabric having a flat surface except for the selvage areas.

g. The product obtained after dyeing and heat-setting the greige had a thickness of 6.5 mm and a width of 30 mm and a breakage strength of 7,500 Kgf. This strength value is only achievable by a conventional product having a width of 50 mm.

EXAMPLE 3

Figure 9A:
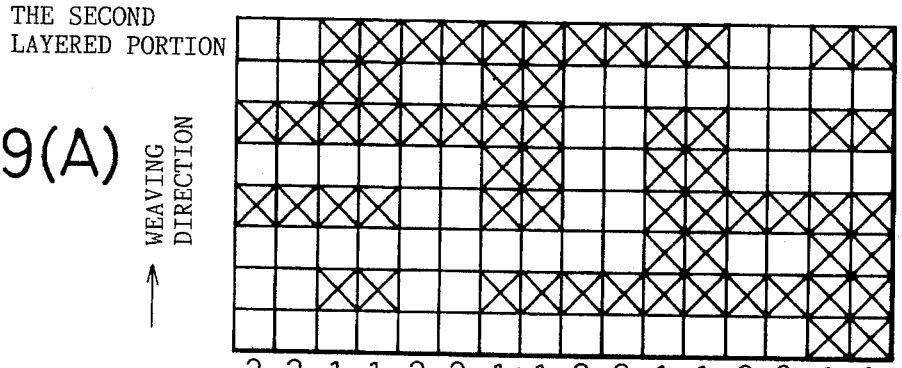
FIGS. 9(A) and 9(B) are weave structures used in a third embodiment of the present invention.
Figure 9B:
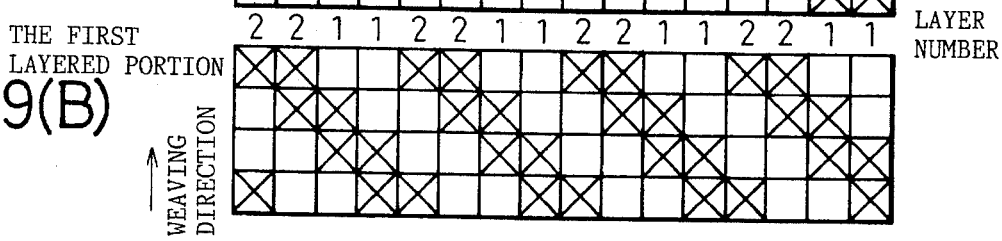

According to this embodiment, a flat wider section 11 consisting of one layer of 2/2 twill weave and having a width of 45 mm and a thickness of 2.8 mm was added in the lengthwise direction to the basic section 10 consisting of four layers of 2/2 twill weave and having a width of 23.5 mm. Particulars are as follows.

a. The width was varied by using a conventional sector-shaped front reed movable upward and downward. In this regard, since the basic section 10 in this example is thicker in the widthwise central area, it is necessary to widen the belt portion as much as possible in the wider section 11. Accordingly, the reed for the wider width section does not have a uniform pitch but has a coarse pitch in the central portion which becomes finer toward the extremities thereof. The basic section 10 of this example was woven in accordance with the weave structure shown in FIG. 7.

b. At the beginning of the widening process, the first and second layers of 2/2 twill weave in the basic section are grouped into a single layer of 2/2 twill weave and the third and fourth layers are grouped into another single layer of 2/2 twill weave so that the original four layers are converted to two layers. Then thus-obtained two layers of 2/2 twill weave are converted to a single layer of 2/2 twill weave at the final stage of the widening process. Such a conversion of weave structure has an advantage in that as the number of layers is reduced, the width can be smoothly increased. In FIGS. 9(A) and 9(B), weave structures in the two layer section and the one layer section are illustrated.

That is, FIG. 9(A) shows a weave structure used for forming a transition section in which the four layers have been converted to the two layers; i.e., that corresponding to the section 13 in FIG. 3, while FIG. 9(B) shows a weave structure used for forming another transition section in which the two layers have been converted to one layer; i.e., that corresponding to the section 11 in FIG. 3.

c. When a wider section is narrowed to become a basic section, the process reverse to the above is carried out.

d. Although it is indispensable that two kinds of wefts are picked while using double shuttles when the basic section is woven as described in Example 1, it is possible to operate only one shuttle and rest another shuttle when the wider section is woven. In this example, one shuttle was used for weaving the two layered portion of the joint section but two shuttles were used for weaving the single layered portion thereof.

e. The number of picks is also varied in accordance with the reduction/increase of layers. As this is done in the conventional manner, the detailed description will be omitted in this text. The number of picks in the wider section in this example was 18 picks/3 cm.

f. The width of the wider section was 46 mm in greige and became to 45.5 mm after heat-setting while the thickness thereof was 2.8 mm.

Since the present invention comprises the above-mentioned technical features, it is possible to provide a narrow woven fabric having a large thickness and a superior breakage strength per unit width exceeding a level of the strength thereof which could be conventionally obtained. Further, it is possible to provide mechanisms for a loom capable of producing such a thick belt. The effects or results of the present invention are as follows:

a. First, a narrow fabric is obtained, capable of being easily manipulated and having a cross-sectional shape closer to that of rope. This narrow width fabric can be used in a field in which a rope has been conventionally used.

b. Second, it is possible to produce a thick belt having a width of more than 6 mm which is the upper limit of the prior art product. As a result, a thick belt is obtainable which has a greater breakage strength relative to the conventional thick belt of the same material and width. Thereby it is possible to reduce the fabric width to maintain the breakage strength at the same level relative to the conventional product made of the same material.

c. Third, since a wider section is provided while extending a basic section corresponding to the thick belt described above, it is possible to connect the fabric by the sewing the wider width section when the same is used in place of a rope. Thus, the popular and conventional rope connecting method called "satsuma" (splice) in Japanese, used for connecting at least two ropes, is not required. Thus, the ease of connecting ropes is greatly improved. Particularly, such the product is suitable as a safety belt or a sling for a flexible container.

d. Fourth, the present thick belt can be effectively woven. The production of the present thick belt might be impossible without the methods disclosed herein.

While this invention has been described in detail with reference to certain preferred embodiments, it should be appreciated that the present invention is not limited to those precise embodiments. Rather, in view of the present disclosure which describes the best mode for practicing the invention, many modifications and variations would present themselves to those of skill in the art without departing from the scope and spirit of this invention, as defined in the following claims.

What is claimed is:

1. A thick belt comprising at least four layers of weave structure including two outer layers and at least two remaining inner layers, said two outer layers being woven into a hollow tube by a common weft and said at least two remaining inner layers being woven by a second weft, the belt having a width and a weave structure providing a rope cross-sectionally shaped portion in a central area thereof, said central area having a cross-sectional shape corresponding to a cross-sectional shape of a rope, a cross-sectional thickness of said central area being greater than one quarter of the belt width.

2. The thick belt according to claim 1 further including two flat end segments adjacent said rope shaped portion, each of said flat end segments being thinner and wider than said rope shaped portion and formed by fewer than four layers of weave structure.

3. A thick belt according to claim 2, wherein said cross-sectional shape of said rope shaped portion in said central area is one of circular shaped and oval shaped.

4. A thick belt according to claim 1, wherein said rope shaped cross-sectional shape in said central area is one of circular shaped and oval shaped.

5. A thick belt comprising at least two layers of weave structure, the thick belt having a width and characterized in that an effective thickness of a warp bundle is greater than 2.5 mm and the belt having a thickness greater than 6.0 mm except for selvage areas, the effective thickness of the warp bundle being a function of the total denier of all warps used in said belt and calculated based on the total denier of all warps used in said belt in accordance with the following formula:

effective thickness of the [virtual] warp bundle = cross-sectional area S ($mm^2$) of said [virtual] warp bundle ÷ woven belt width (mm)

wherein the cross-sectional area S of said warp bundle is determined assuming a cross-sectional shape thereof as circular, a diameter thereof in mm being determined by the following formula:

$$.0119\sqrt{(\text{total denier of warps used in the belt}) \div (\text{specific gravity of fiber})}$$

6. The thick belt according to claim 5 further including two flat end segments adjacent said thick belt, each of said flat end segments being thinner and wider than said thick belt and formed by fewer than four layers of weave structure.

7. A thick belt comprising a body portion having a cross sectional shape corresponding to that of a rope, and belt portions having a cross sectional shape corresponding to that of a flattened rectangle, the body portion and the belt portions being of different woven structures, the body portion having a thickness larger than that of the belt portion and a width smaller than that of the belt portion.

8. A thick belt according to claim 7, wherein said thickness of said body portion is larger than one quarter of the width of said belt portion.

* * * * *